US007065822B1

(12) United States Patent
Vandenburg

(10) Patent No.: US 7,065,822 B1
(45) Date of Patent: Jun. 27, 2006

(54) LINT REMOVER

(76) Inventor: Stephanie Vandenburg, 182 Sandalwood Dr., Staten Island, NY (US) 10308

( * ) Notice: Subject to any disclaimer, the term of this patent is extended or adjusted under 35 U.S.C. 154(b) by 0 days.

(21) Appl. No.: 11/129,810

(22) Filed: May 16, 2005

(51) Int. Cl.
*A47L 25/00* (2006.01)

(52) U.S. Cl. ..... 15/104.002; 15/236.6

(58) Field of Classification Search ..... 15/104.002, 15/236.01, 236.06
See application file for complete search history.

(56) References Cited

U.S. PATENT DOCUMENTS 3,089,170 A * 5/1963 Buchsbaum ..... 15/105
3,398,418 A 8/1968 Bogner et al.
4,575,890 A * 3/1986 Hidle ..... 15/104.002
4,769,913 A 9/1988 Kuramochi
5,077,856 A 1/1992 Freundl
5,461,781 A 10/1995 Pirc
5,533,223 A 7/1996 Ho
5,829,143 A 11/1998 Gilliam
D437,087 S 1/2001 Yamagishi

* cited by examiner

*Primary Examiner*—Randall Chin
(74) *Attorney, Agent, or Firm*—Lawrence J. Gibney, Jr.

(57) ABSTRACT

The present invention provides a means for its user to remove unwanted pieces from sweaters or other clothing items and maintain the general appearance of clothing, particularly but not limited to sweaters. Such unwanted items may be lint, pulls, or snags. The present invention would allow its user to maintain the image of clothing.

1 Claim, 4 Drawing Sheets

LINT REMOVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the maintenance of clothing including the removal of lint and the repair of snags.

B. Prior Art

Prior art exists which relates to the maintenance of clothing items. Freundl U.S. Pat. No. 5,077,856, Gilliam U.S. Pat. No. 5,829,143, Kuramochi U.S. Pat. No. 4,769,913, and Bogner U.S. Pat. No. 3,398,418 are examples of prior art patents, which specifically focus on the removal of lint from clothing. There is, however, no prior art which combines the ability to remove lint, cut away and store unwanted pieces from the clothing, and a device to push snags through the clothing.

BRIEF SUMMARY OF THE INVENTION

The present invention has a T-shape and combines the functions of a lint remover, snag remover and sweater shaver in one device.

The handle of the present invention is the portion of the device, which contains the lint removal device. The material for the lint removal in an adhesive. The handle will be the approximate size to fit within the palm of a person's hand. The lint removal material is contained in a portion of the handle, which is cylindrical.

At another part of the device is a sweater shaver with metal blades, an adjustable opening for different blades and a cover. The blades can be adjusted to accommodate different types of material. The shaver will also have a push button to allow the user to remove shavings acquired through use. Additionally, lubricating strips may also be included in close proximity to the metal blades for ease of operation.

The present invention will be equipped with a small protrusion tool at the opposite end from the shaver near the handle. The protrusion tool will be positioned perpendicular to the handle and will be attached to the surface of the handle. This protrusion tool will push hanging threads and snags to the underside of clothing, particularly sweaters, but not limited to sweaters, to maintain a neat appearance.

It is an object of this device to make one tool, which can maintain clothing, particularly sweaters, in a portable unit.

DETAILED DESCRIPTION OF THE EMBODIMENT

The present invention is a tool 10 for the maintenance and repair of a sweater or other similar clothing items.

Figure 1:
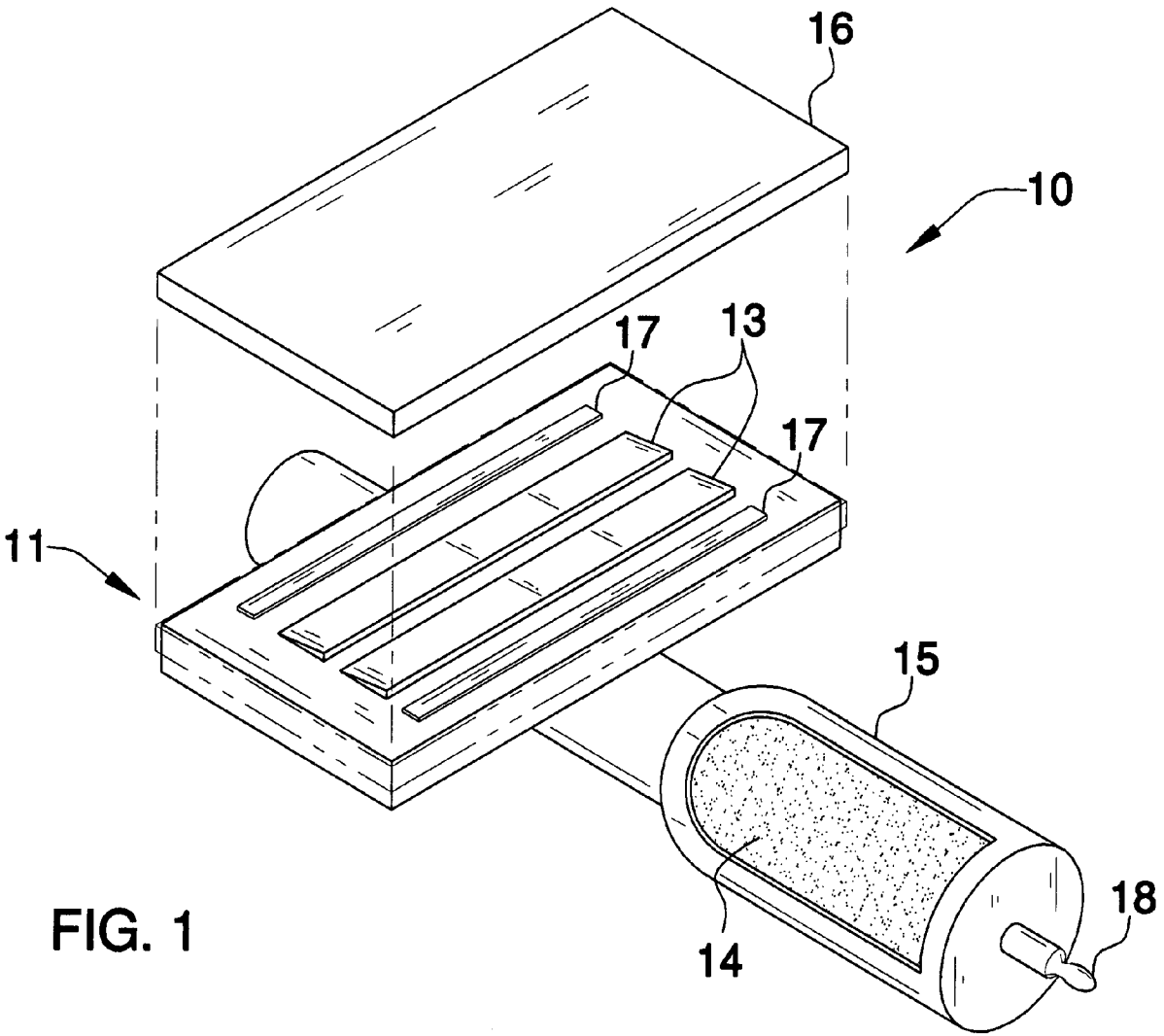
FIG. 1 is an isometric view of the device and an exploded view of the head of the device.
Figure 3:
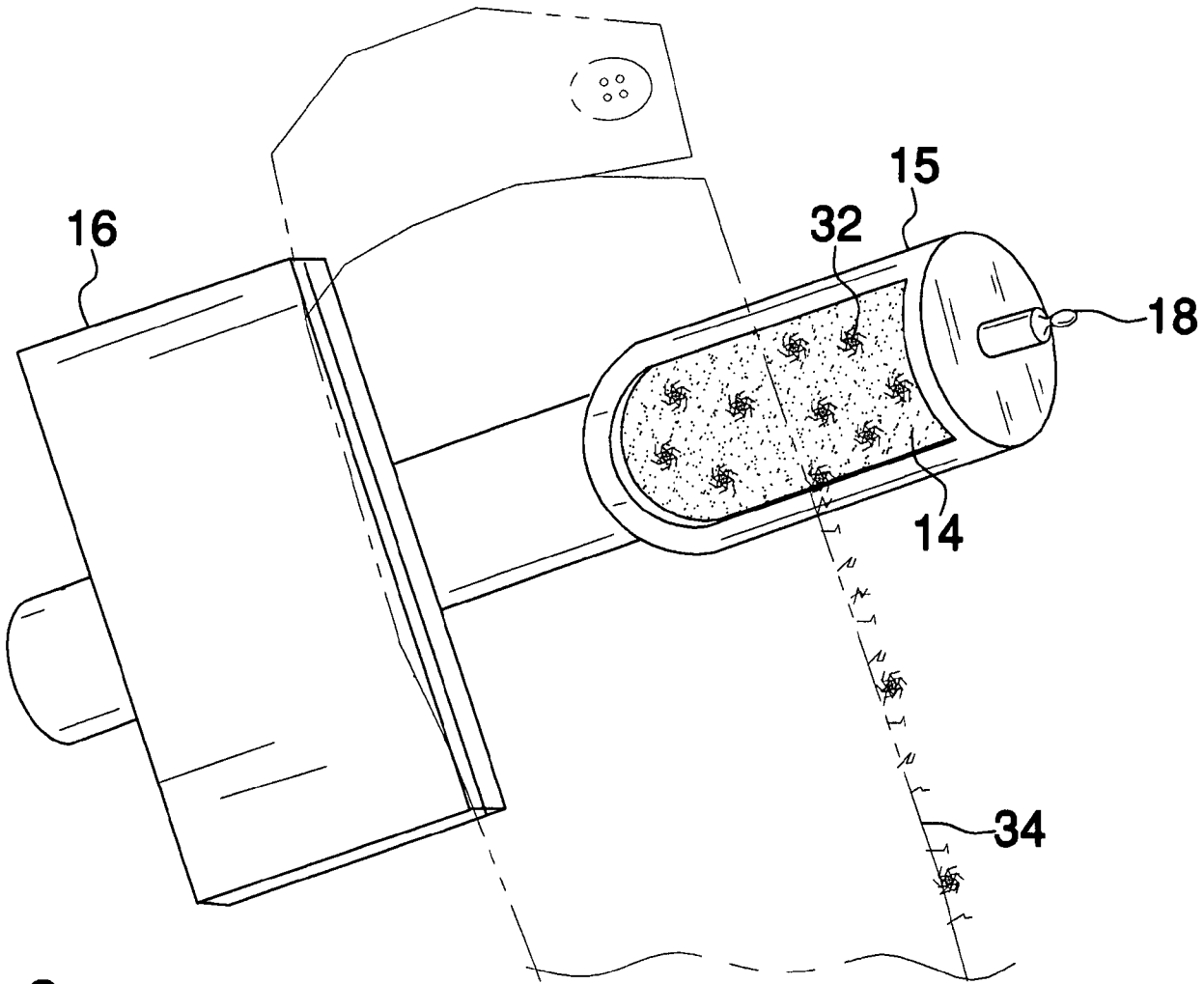
FIG. 3 is a depiction of the lint roller in use.

The tool 10 has a handle 15, a portion of which functions also as a lint brush 14. This lint brush 14 will be of a material that will allow the user to easily remove lint 32, while maintaining sufficient grip on the tool 10. FIGS. 1, 3 The material for the lint brush is commonly used today and is an adhesive material. The surface of the lint brush 14 will be approximately one-half of the handle 14 and the handle will fit within the palm of a person's hand. This will allow the user to remove lint 32 from a sleeve 34 while gripping the handle 15. FIGS. 1, 3

Figure 2:
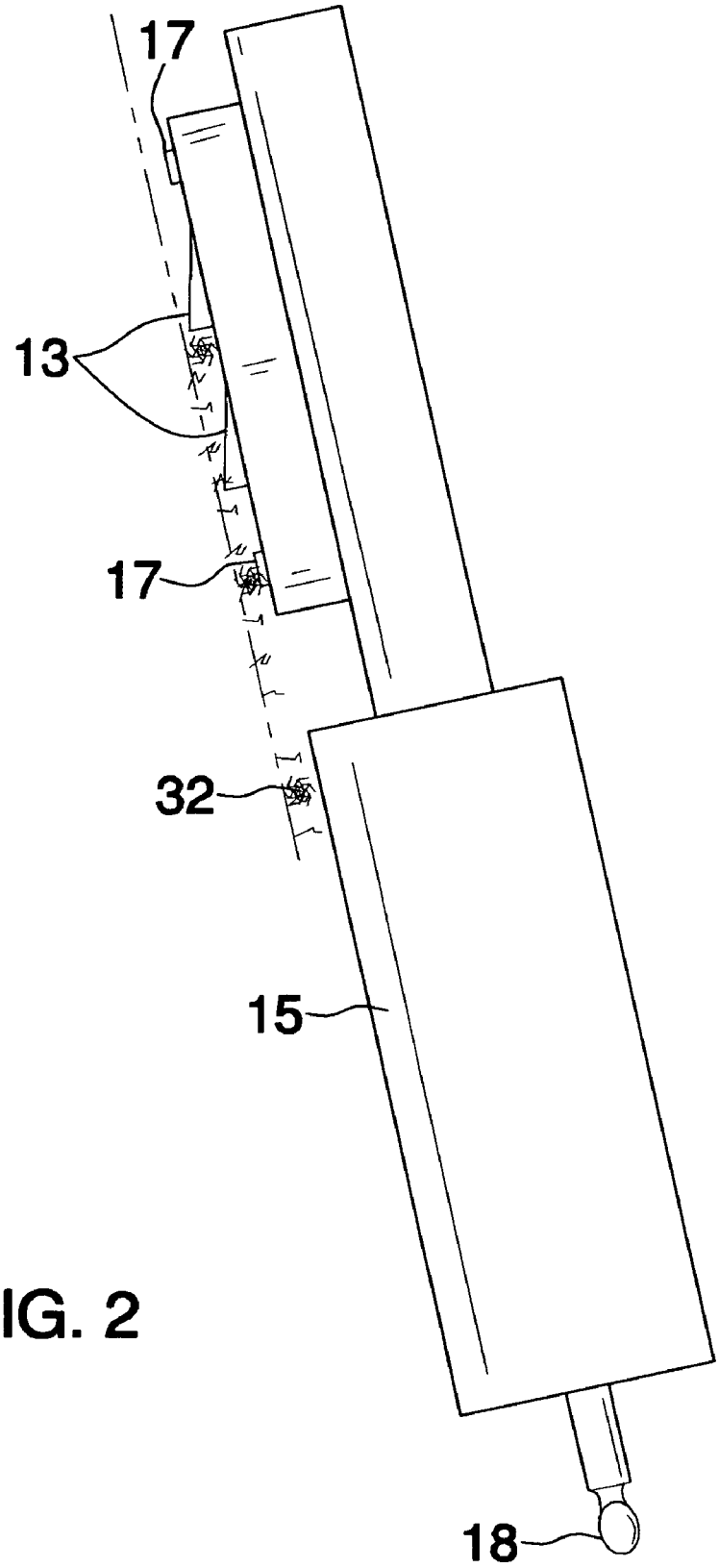
FIG. 2 is a side view of the shaver head of the device in use.

At one end of the tool 10 is a shaver head 11, which is used to cut and also remove lint 32 from the clothing. It will also cut unwanted loose pieces from the clothing for a neater appearance. FIG. 2 The shaver head 11 will accommodate different sized blades 13 and allow the user to alter the space between the blades within the shaver head 11 to accommodate different types of clothing material. FIGS. 1, 2

A cover 16 will cover the blades 13 when that part of the device is not in use. FIGS. 1, 3 Under the plastic cover 16 for the shaver 11 are a series of adjustable blades 13 and lubrication strips 17 on the outer edges of the shaver 11. The purpose of the lubrication strips 17 is to insure smooth operation of the shaver 11 during operation of the device.

The shaver head 11 will also have a means to release trimmings acquired through the shaving action.

Figure 4:
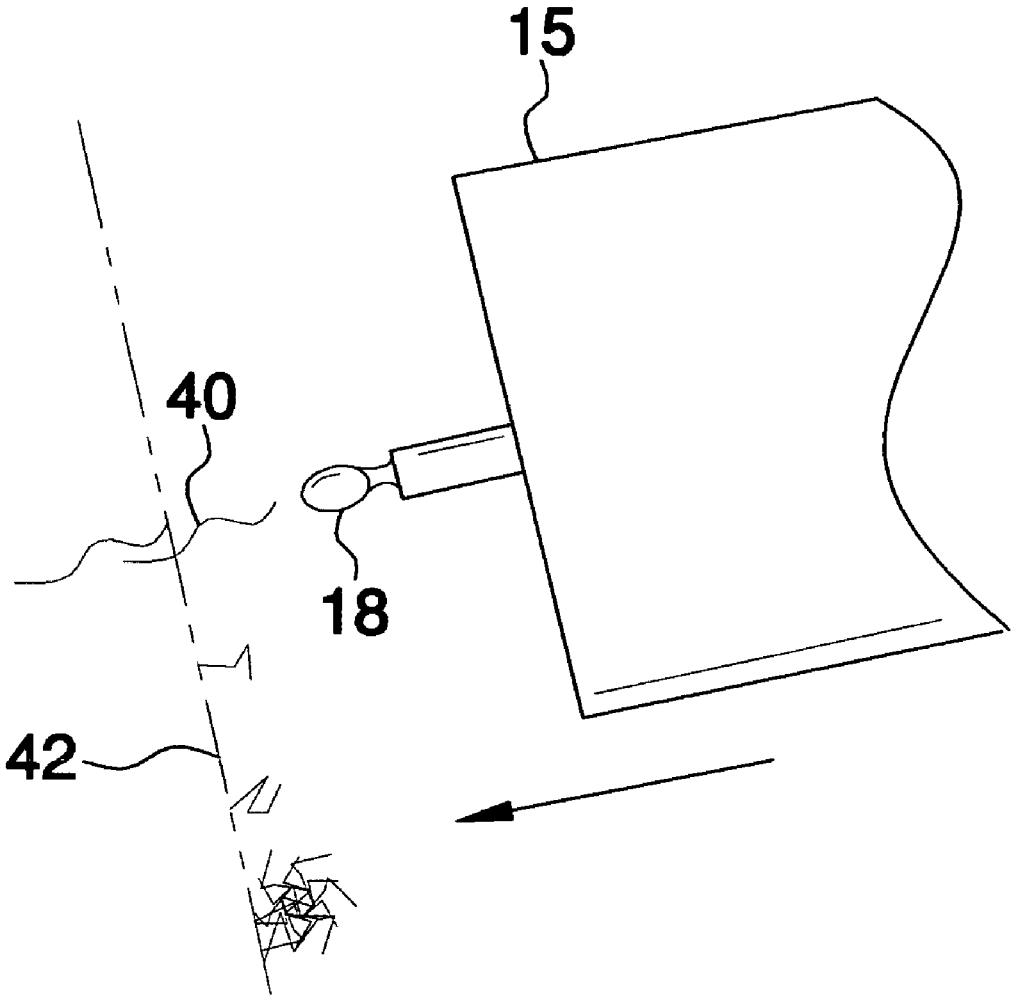
FIG. 4 is a depiction of the protrusion tool in use.

At the opposite end from the shaver head 11 and positioned perpendicular on a surface of the handle is a protrusion tool 18. FIGS. 1, 4 The protrusion tool 18 is a thin, elongated rigid piece with a notch, which allows the user to push unwanted strings, snags or threads 40 and other pieces of material through the top or visible surface of the clothing to the underside of the sweater surface 42. The protrusion tool 18 helps to maintain the general appearance of the clothing by removing or at least hiding unwanted threads or snags 40. FIG. 4

Additionally, an alternate embodiment of the present invention will have a strip lubricated with fabric softener which can be applied to the sweater material while lint 32 is removed.

The device must be rigid and durable and plastic is probably an appropriate choice of material.

The invention claimed is:

1. A device for maintaining the appearance of a clothing item comprising:

a. a handle;

wherein said handle is of a substantially cylindrical shape;

wherein said handle has a top and bottom end;

wherein said handle is sufficiently rigid to maintain stability;

wherein a lint removal material is incorporated into a portion of said handle;

b. a shaving head;

wherein said shaving head is fixedly attached to one end of the device;

wherein said shaving head has a desired number of blades spaced apart from each other;

wherein said shaving head has a mechanism for altering the spacing between the blades;

wherein said shaving head has a button which, when depressed, releases accumulated trimmings from within the shaving head;

wherein said shaving head is provided with a cover;

c. a protrusion tool;

wherein said protrusion tool is of a substantially thin, elongated, and cylindrical shape;

wherein said protrusion tool is of a sufficiently rigid material;

wherein said protrusion tool has a first and second end;

wherein said first end is fixedly attached to the bottom end of said handle;

wherein said second end has a notch to hold a selected snag in place.

* * * * *